US008756828B2

(12) United States Patent
Dalton et al.

(10) Patent No.: US 8,756,828 B2
(45) Date of Patent: Jun. 24, 2014

(54) FAILURE MODE DETECTION IN AN APPLIANCE DISPENSING SYSTEM

(75) Inventors: Michael T. Dalton, Saint Joseph, MI (US); Fredrick E. Chernetski, Saint Joseph, MI (US); Karl D. McAllister, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 828 days.

(21) Appl. No.: 12/113,381

(22) Filed: May 1, 2008

(65) Prior Publication Data

US 2009/0272003 A1 Nov. 5, 2009

(51) Int. Cl.

| | |
|---|---|
| ***F26B 11/02*** | (2006.01) |
| ***D06F 58/02*** | (2006.01) |
| ***D06F 58/28*** | (2006.01) |

(52) U.S. Cl.

USPC ..... 34/524; 34/597; 68/5 C

(58) Field of Classification Search

USPC ..... 34/597, 531, 389, 390, 528, 536, 541, 34/542, 585, 607, 329, 524; 68/5 R, 5 C, 68/12.04, 12.07, 12.18, 59; 38/1 A; 222/59, 77

See application file for complete search history.

(56) References Cited

U.S. PATENT DOCUMENTS

| | | | | |
|---|---|---|---|---|
| 4,656,873 | A * | 4/1987 | Stewart | 73/861.33 |
| 4,763,494 | A | 8/1988 | Der Kinderen | |
| 4,921,129 | A | 5/1990 | Jones et al. | |
| 5,747,350 | A | 5/1998 | Sattler | |
| 5,796,067 | A | 8/1998 | Enyedy et al. | |
| 6,089,242 | A * | 7/2000 | Buck | 134/57 R |
| 6,371,331 | B1 * | 4/2002 | Gohde et al. | 222/55 |
| 6,973,867 | B2 * | 12/2005 | Frisch et al. | 91/459 |
| 2002/0088502 | A1 | 7/2002 | Van Rompuy et al. | |
| 2004/0036290 | A1 * | 2/2004 | Bock et al. | 285/343 |
| 2005/0212532 | A1 * | 9/2005 | Bernhard | 324/664 |
| 2006/0060214 | A1 | 3/2006 | Rosenbauer | |
| 2006/0081016 | A1 | 4/2006 | Hsu et al. | |
| 2006/0254626 | A1 | 11/2006 | Botts et al. | |
| 2007/0094888 | A1 * | 5/2007 | Barron et al. | 34/597 |
| 2008/0000098 | A1 * | 1/2008 | Choi et al. | 34/114 |
| 2008/0141734 | A1 * | 6/2008 | Son et al. | 68/5 C |
| 2008/0209757 | A1 * | 9/2008 | Park et al. | 34/389 |

FOREIGN PATENT DOCUMENTS

| | | | |
|---|---|---|---|
| DE | 3901696 | A1 | 7/1990 |
| DE | 10 2006 003 416 | A1 | 7/2007 |
| EP | 1520925 | A2 | 4/2005 |
| EP | 1731654 | | 12/2007 |
| GB | 2134078 | A | 8/1984 |
| KR | 10 2007 0 037 127 | A | 4/2007 |
| WO | 0220893 | A1 | 3/2002 |
| WO | 2008010670 | A2 | 1/2008 |

* cited by examiner

*Primary Examiner* — Jiping Lu

(57) ABSTRACT

An appliance having a dispensing system and a detection system for detecting failure modes related to the dispensing system.

7 Claims, 4 Drawing Sheets

FAILURE MODE DETECTION IN AN APPLIANCE DISPENSING SYSTEM

BACKGROUND OF THE INVENTION

1. Field of the Invention

The invention relates to a system for detecting failure modes related to a dispensing system in an appliance.

2. Description of the Related Art

A typical cleaning appliance, such as a clothes washing machine or clothes dryer, includes a cabinet that in the case of a dryer, houses a rotatable drum, or in the case of a washer, houses a rotatable wash basket within a tub that defines a fabric treatment chamber. A motor is usually coupled to the drum/basket to control rotation of the drum/basket. The drum/basket has an access opening that may be selectively closed by a door. The motor can rotate the drum/basket at various speeds in order to manipulate fabric articles within the fabric treatment chamber.

Some clothes dryers include a dispensing system for dispensing chemistry or water inside the clothes dryer. For example, a clothes dryer may include a dispenser to spray water, fabric softeners or other fluids into the drum during a drying cycle to prevent wrinkles from forming or reduce existing wrinkles. As a result of this trend, the ability to accurately and efficiently dispense chemistry inside a clothes dryer is becoming a critical enabler behind increasing overall machine performance and consumer satisfaction. Operating an appliance without a properly functioning dispensing system may negatively impact the performance of the appliance.

SUMMARY OF THE INVENTION

An appliance having a dispensing system and a detection system for detecting failure modes related to the dispensing system.

DETAILED DESCRIPTION OF THE EMBODIMENTS

Figure 1:
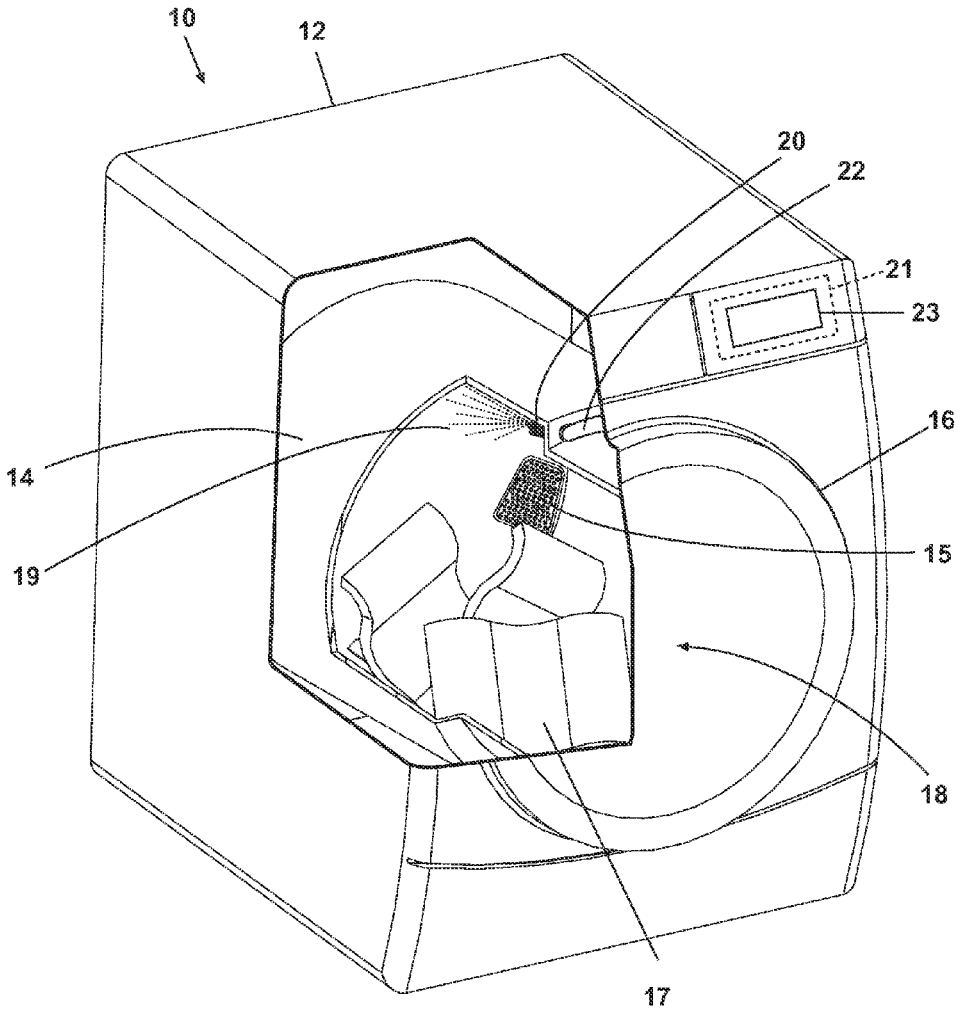
FIG. 1 is a partially cut-away, perspective view of a clothes dryer having an intelligent dispensing system and failure mode detection system embodying the present invention.
Figure 2:
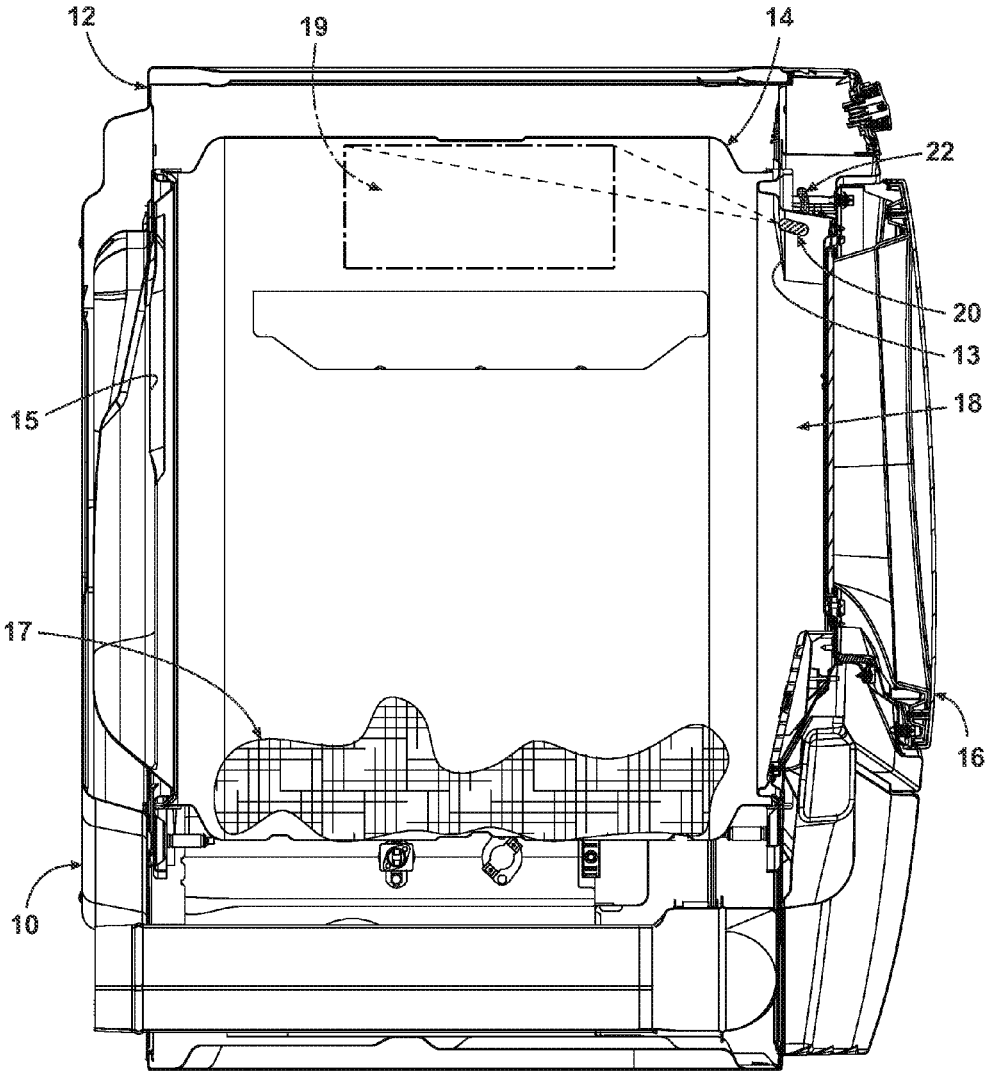
FIG. 2 is a longitudinal sectional view of the clothes dryer of FIG. 1 illustrating the dispensing system and failure mode detection system according to one embodiment of the present invention.

As shown in FIG. 1, according to one embodiment of the invention an appliance 10 may be provided with a cabinet 12 having a door 16 for selectively opening and closing an access opening 18 to a treatment chamber 19. Although the appliance 10 is depicted as a clothes dryer, the dryer is exemplary, and the present invention may also be used in other appliances, such as, for example, a clothes washing machine, a combination washer and dryer, or a fabric freshening device. The cabinet 12 may house a rotatable drum 14 that defines the treatment chamber 19 for the treatment of fabric articles 17, although other configurations for the chamber 19 may also be used. Referring to FIG. 2, the appliance 10 may also have a dispenser 20 for dispensing a fabric-conditioning substance, described below, into the drum 14. The fabric-conditioning substance may be delivered to the dispenser 20 via a conduit 22. When operated, the drum 14 may rotate, thereby tumbling the fabric articles 17 within the drum 14. The dispenser 20 may be configured to dispense a fabric-conditioning substance into the drum 14, either directly onto the fabric articles or onto an inner surface of the drum 14.

Figure 3:
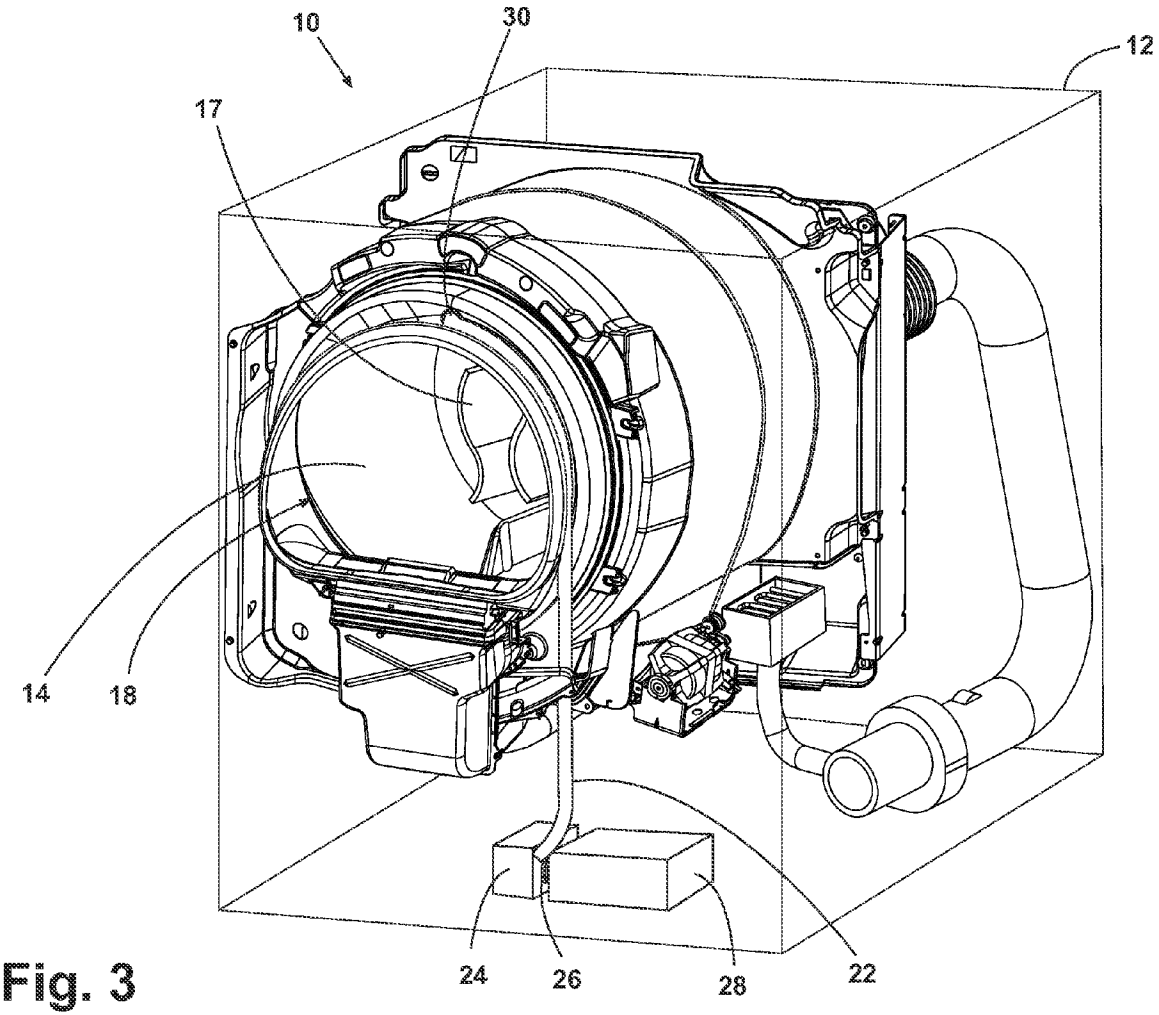
FIG. 3 is a perspective view illustrating the appliance of FIG. 1 with the cabinet shown schematically to better illustrate the interior elements within the clothes.

As shown in FIG. 3, the dispensing system may include a mounting fixture 30 coupled with the dispenser 20 (see also FIG. 1), and a corresponding reservoir 28, delivery apparatus 24, and conduits 22, 26 for delivering a fabric-conditioning substance from the reservoir 28 to the dispenser 20. In one implementation, the reservoir 28 holds a liquid fabric-conditioning substance, and the delivery apparatus 24 may be a pump that pumps the liquid from the reservoir 28 to the dispenser 20, which may be a spray nozzle that controls the spray pattern of the fabric-conditioning substance into the drum.

Referring back to FIG. 1, a controller 21, having a user interface 23, may be provided for controlling the operation of the components if the appliance, including the dispensing system in accordance with control logic for the appliance, which may include pre-programmed cycles of operation that the user may select through the user interface 23 or enter cycle parameters and options through the user interface 23. The controller 21 may be operably coupled to the components as need be to control the operation.

The dispenser 20 may be used to dispense a variety of fabric-conditioning substances into the appliance. For example, the fabric-conditioning substance may be a fluid, vapor, powder, or phase changing liquid. More specifically, the fabric-conditioning substance may be water, or various mixtures of fabric softeners, detergents, surfactants, builders, emulsifiers, perfume fixatives, perfume binders, perfume carriers, and various other substances known to those skilled in the art. These chemistries may be used to prevent wrinkles from forming and to remove odors from fabric articles. Additionally, a fabric-conditioning substance that aids in fabric softening, fragrance addition, and anti-static guard may also be used. The dispensing system may also deliver functional finishes, or fabric care additives, such as stain guards and other coatings or chemistries that reduce color loss, reduce or reverse color changing fabric shrinkage, and other fabric wear characteristics. Finally, the chemistries may include ingredients to sanitize the clothes load and add other hygienic treatments to the garments being processed. Thus, any fabric-conditioning substance that aids in creating these features is within the scope of the invention.

There are a variety of potential failure modes associated with a dispensing system. For example, after dispensing, some chemistries could potentially leave a residue inside the dispensing system which over time could potentially thicken and clog the components. Certain chemistries dry out when exposed to air, especially in small volumes, and may leave a coating of chemistry in the dispensing system. As a result, various components, such as the dispenser 20, the outlet of the reservoir 28, the delivery apparatus 24, or a conduit 22, 26, for example, associated with the system, may become partially or completely clogged. A restriction in the system may lead to inefficient dispensing or may eventually prevent the system from dispensing any fabric-conditioning substance. As a result, the fabric articles may not be coated with the fabric-conditioning substance as expected, thus decreasing customer satisfaction. Furthermore, a leak may potentially develop in a component associated with the dispensing system, which may cause a waste of expensive fabric-conditioning substance and potentially cause internal machine or property damage. Another failure mode may occur when a component, such as the dispenser 20 or reservoir 28, is missing. It is foreseeable that a user may remove the dispenser 20 to clean it and may attempt to operate the appliance 10 without replacing the dispenser 20. Similarly, the reservoir 28 may be removable in order to be cleaned or refilled, or may be a replaceable cartridge, and may not be replaced after removal. Finally, a failure mode may occur when the reservoir 28 is empty and a user neglects to refill it. In each of these situations, the dispensing system may not coat the fabric articles with fabric-conditioning substance as expected and may lead to decreased performance of the dispensing system. Additionally, these failure modes may lead to excess flow from the dispensing system as it attempts to compensate for the failure mode, which may damage the fabric articles.

In order to manage the potential occurrence of failure modes, various failure mode detection systems may be included in the appliance 10. For example, a plurality of sensing devices embedded within the appliance 10 or components of the appliance 10 may be used to alert the user when a failure mode has occurred and initiating corrective action, when possible. One method of detecting failure modes related to the dispensing system involves the use of a microprocessor, which may be included with the controller 21, to monitor signals from the delivery apparatus 24. For instance, the delivery apparatus 24 may be a pump, or a blower, having a motor. The pump or blower may be a variable speed device, such as an impeller based pump, a peristaltic type pump, and the like. When one or more failure modes occur, the signals from the motor will be affected. For example, if the dispenser 20 is restricted, the pump will try to compensate to achieve the desired flowrate. In this situation, the electrical current drawn, speed, power, and voltage may increase. Thus, by measuring parameters such as electric current drawn, speed, power, voltage, and phase lag, the appliance 10 may identify failure modes such as a clogged dispenser 20, a clogged conduit 22, 26, an empty reservoir 28, a leak in the dispensing system, and a lack of dispenser 20. These signals may be monitored through the microprocessor and may be used to notify a user of the failure mode and to correct the failure mode, when possible. The notification may occur through the user interface 23, which may include a display on which a message or error code may be displayed or it may include one or more indicators, such as dedicated light, which may be in combination with a sound, such as a buzzer.

Figure 4:
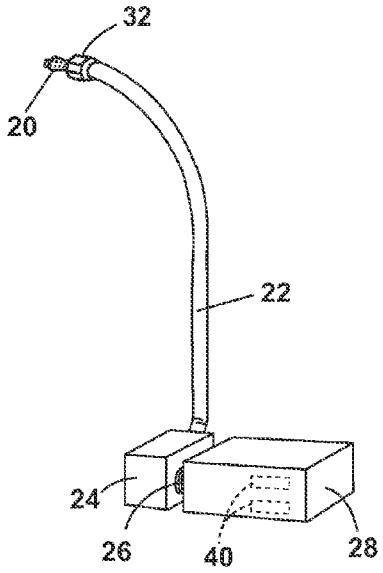
FIG. 4 is a perspective view illustrating a dispensing system including a failure mode detection system according to one embodiment of the invention.

Another system that may be used to detect an empty reservoir are sensors provided within the reservoir 28 to measure the level of fabric-conditioning substance remaining in the reservoir 28. The sensors may be configured to send a signal to a microprocessor, which will interpret the signal and display the fabric-conditioning substance level to a user. For example, the appliance may include a user interface for indicating the level of fabric-conditioning substance in the reservoir, such as low, medium, and high. The level may be indicated using LEDs or similar displays so a user may know when to refill or replace the reservoir. Alternatively, the user interface may be configured to display an error message when the reservoir is empty using an LED or a buzzer. Referring to FIG. 4, one sensor system that may be used to determine the level of fabric-conditioning substance remaining in the reservoir 28 may be a series of electrodes 40. One or more electrodes 40 may be provided within the reservoir 28 and a signal may be measured between these electrodes 40 and a grounded reference electrode. Thus, presence of the fabric-conditioning substance may be detected by the electrodes 40. Other sensor systems may also be used.

As shown in FIG. 4, another example of a failure mode detection system includes a flowmeter 32 positioned to measure a flowrate of the fabric-conditioning substance through the dispensing system. The flowmeter 32 may be located in several positions, including between the dispenser 20 and mounting fixture 30, as shown in FIG. 3, or between the mounting fixture 30 and the outlet of the delivery apparatus 24. The flowmeter 32 measures the volume or mass flow of the fabric-conditioning substance through the dispenser 20 and may be operably coupled to the controller 21 such that the microprocessor may receive the signal output from the flowmeter for purposes of determining the rate of flow. Most flowmeters output a signal that must be processed by the microprocessor to determine the flow rate and that flow rate is then compared against a reference value. For example, some flowmeters using a rotating wheel and for each revolution of the wheel a high voltage is sent to the microprocessor, which tracks the revolutions over time. The rate of the revolutions is indicative of the flow rate. Regardless of the type of flowmeter used, if the conduit is clogged, or there are any obstructions in the dispensing system before reaching the dispenser 20, the flowmeter 32 may be used to detect a decreased flowrate and the user will then be notified of the failure mode and correct the failure mode, when possible.

Figure 5:
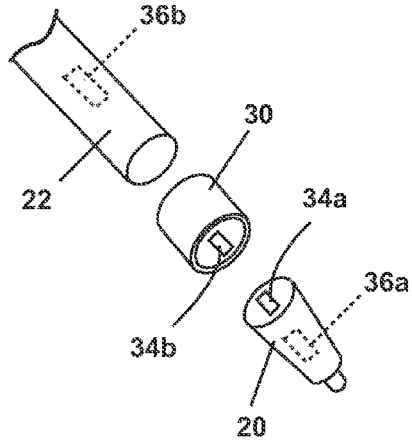
FIG. 5 is an exploded perspective view illustrating a dispensing system including a failure mode detection system according to one embodiment of the invention.

Another embodiment of a failure mode detection system to detect clogs or leaks in the dispensing system is described with reference to FIG. 5. An electrode **36*a* may be provided within the dispenser 20 to be in contact with the fabric-conditioning substance being dispensed. A second electrode 36*b* may be in contact with the fabric-conditioning substance elsewhere in the fabric-conditioning substance path, for example, within the conduit 22. The second electrode 36*b* may also be provided elsewhere within the dispenser 20. One of the electrodes 36*a*, 36*b* may be charged. For example, the second electrode 36*b* may be upstream of the dispenser 20 and charged with a low voltage. The output of the electrodes 36*a* and 36*b* may be directly or indirectly operably coupled controller 21, which processes the signals to determine of a failure has occurred. Thus, when a fabric-conditioning substance moves through the conduit 22 and to the dispenser 20, the fabric-conditioning substance completes an electrical circuit between the two electrodes 36*a*, 36*b*. This enables a determination to be made whether the fabric-conditioning substance is being dispensed through the system as expected. To determine this, the microprocessor may determine whether the circuit was ever closed, or determine the time elapsed between the electrical circuit closing and another step in the cycle, thereby calculating the time required for the fabric-conditioning substance to reach the dispenser 20 from the reservoir 28. When the fabric-conditioning substance reaches the electrode 36*a* in the dispenser 20, it acts as a switch and alerts the machine that the fabric-conditioning substance has reached the dispenser 20. This time alone may be indicative of a failure. However; this time may be compared to another system event that initiates dispensing, such as a pump starting or a valve opening, may define a lag time, telling the machine how long it has taken for the fabric-conditioning substance to reach the dispenser 20. Thus, the microprocessor has information indicative of the lag time. The microprocessor may then be able to compare the measured lag time to the expected lag time for an unclogged or leak-tight system. Any difference between the measured lag time and expected lag time may be indicative of a failure mode and may be further correlated to the amount of clogging or leaking in the dispensing system. Alternatively, there may be three or more electrodes provided. The energized electrode may be upstream near the delivery apparatus 24, a second electrode may be provided in the conduit 22, and a third electrode may be provided in the dispenser 20**. Comparing the time it takes to complete the circuit between the first and second electrode and the first and third electrode indicates the flowrate of the fabric-conditioning substance. Thus, it should be readily understood that the number of electrodes may be altered without changing the scope of the invention, as long as a minimum of two electrodes are provided.

Another implementation of a failure mode detection system includes a sensor to detect if a component in the dispensing system may be present or not. This type of sensor may be especially useful on components that are potentially removable, such as the dispenser 20 and the reservoir 28. For example, as shown in FIG. 5, one or more electrodes 34*a* may be provided on the dispenser 20 to align with one or more electrodes 34*b* provided on a coupling device, such as the mounting fixture 30. One of the electrodes 34*a*, 34*b* may be charged. For example, the electrode 34*b* may be charged with a low voltage. When the dispenser 20 is installed, the electrodes 34*a*, 34*b* may be aligned, thus completing an electrical circuit that may be detected by a microprocessor. The physical design of the electrodes on both the component and the appliance may be unique to the component, thus preventing insertion of incorrect components. As a result, only the intended components may complete the electrical circuit. Although a dispenser 20 is shown in FIG. 5, similar electrodes may be used on other components in the dispensing system. Various other types of electrical sensors, such as reed switches and capacitive sensors, may also be used in place of electrodes. With a reed switch, two magnetizable and electrically conductive metal reeds may be housed in the appliance wherever the removable or disposable component is to be placed. When placed in appropriate proximity to the reeds, the component will generate a magnetic field and pull the reeds together. Thus, a completed electrical circuit may be detected by a microprocessor. One benefit of using a reed switch is that it is a sealed system and no contacts are exposed, so it may work effectively in potentially wet environments such as dispensing chambers. Likewise, a capacitive proximity sensor senses the dielectric strength of a component in its proximity and also does not require exposed contacts. A further advantage of capacitive proximity sensors is that their sensing threshold may be controlled to be able to detect a variety of dielectric strengths, and thus a variety of component materials.

Figure 6:
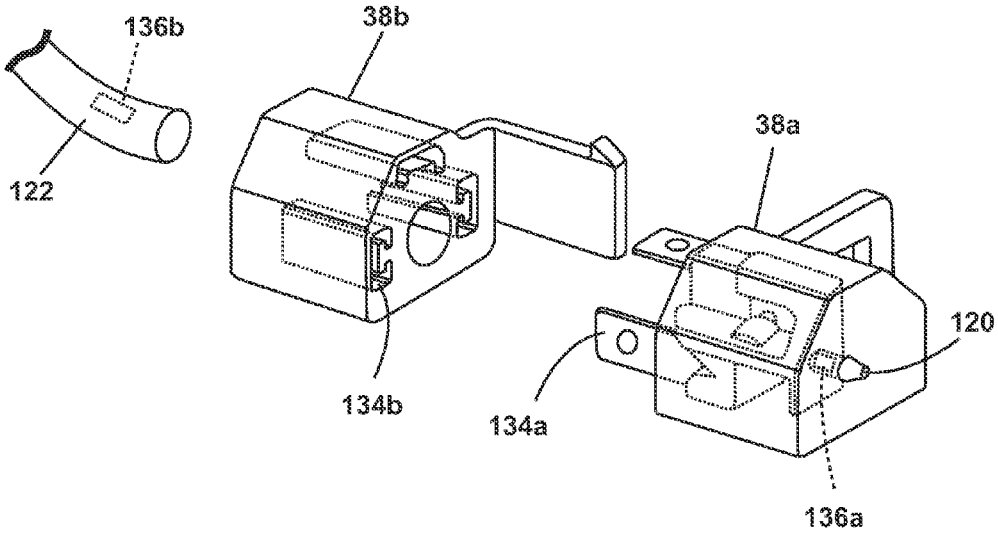
FIG. 6 is an exploded perspective view illustrating a dispensing mechanism including a failure mode detection system according to one embodiment of the invention.

An alternative implementation of the failure mode detection system involving electrodes is illustrated in FIG. 6. As shown, the nozzle or dispenser 120 may be coupled with an enclosure 38 (not identified in FIG. 6). The enclosure 38 may have a removable portion 38*a* and a stationary portion 38*b*. This configuration may facilitate removal of the dispenser 120 for cleaning or replacement. The removable portion 38*a* may include one or more electrodes 134*a* to align with one or more electrodes 134*b* provided on the stationary portion 38*b*. At least one of the electrodes may be charged. For example, the electrode 134*b* may be charged with a low voltage. When the dispenser 120 is installed, the electrodes 134*a*, 134*b* may be aligned, thus completing an electrical circuit that may be detected by a microprocessor. As described above, various other types of electrical sensors, such as reed switches and capacitive sensors, may also be used in place of electrodes. These electrodes 134*a*, 134*b* may detect if a component in the dispensing system is present or not.

In the implementation shown in FIG. 6, additional electrodes may be used to detect clogs or leaks in the dispensing system. For example, an electrode 136*a* may be provided within the dispenser 120 to be in contact with the fabric-conditioning substance being dispensed. A second electrode 136*b* may be in contact with the fabric-conditioning substance elsewhere in the fabric-conditioning substance path, for example, within the conduit 122. As previously described, one of the electrodes may be charged. For example, the electrode 136*b* may be charged with a low voltage. Thus, when an unrestricted flow of fabric-conditioning substance moves through the conduit 122 and to the dispenser 120, the fabric-conditioning substance may complete an electrical circuit between the two electrodes 136*a*, 136*b*. As a result, the microprocessor may measure the amount of time required for the fabric-conditioning substance to reach the dispenser 120 to determine the amount of restriction in the dispensing system.

Another potential failure mode is related to over-dispensing of fabric-conditioning substance, which may damage fabric articles. In order to prevent this from occurring, the detection system may include a plurality of sensors to monitor and measure machine parameters associated with an excess amount of fabric-conditioning substance being dispensed. For example, sensors may be provided to measure drum torque or load weight. An increase in torque or weight beyond a pre-determined value may indicate that an excess amount of fabric-conditioning substance has been dispensed. Furthermore, a sensor may monitor drum temperature, as a cooler than expected temperature may indicate that an excess amount of fabric-conditioning substance has been dispensed in the drum. Alternatively, the appliance may use moisture bar readings to detect a higher than expected number of wet hits, or an increasing number of wet hits, which may also indicate that an excess amount of fabric-conditioning substance has been dispensed. There are numerous other sensors that may also be employed, such as sound level meters to detect excess sloshing of fabric-conditioning substance, or capacitive sensors for sensing liquid levels in the drum. Finally, level sensors may be provided within the reservoir and a rapidly decreasing level of fabric-conditioning substance may indicate over-dispensing. It can be readily understood that one or more of these sensors may be provided in combination without departing from the scope of the invention.

It can be readily understood that any combination of the above described failure mode detection systems may be used in the appliance. For example, the appliance may include a flowmeter, algorithms to monitor signals from the delivery apparatus motor, and electrodes to detect a presence of the dispenser. Alternatively, the appliance may include only algorithms to monitor signals from the delivery apparatus motor and may still achieve the desired function. As a greater number of detection systems are included, the likelihood of detecting failure modes increases.

In operation, the failure mode detection systems detect failures, and the appliance has the flexibility to respond to any failure mode that may be detected. For example, the appliance may modify the duration of dispensing time depending on whether or not the dispenser is partially clogged. In order to compensate for a partially clogged dispenser, the dispensing time may be increased to achieve the desired machine performance and flowrate. When excess flow is detected, possibly due to a leak or missing component, the appliance may turn off the dispensing system completely due to the unexpected outlet conditions. This reaction may further include shutting the entire appliance down, as an excess amount of liquid or a leak may cause an electrical short circuit in the appliance. Furthermore, an excess amount of liquid or a leak may cause damage to a user's property external to the appliance.

Alternatively, the appliance may initiate an alternate cycle when a failure mode is detected. For example, if the dispenser is missing, in order to prevent excess flow from the dispensing system, the appliance may use an alternate cycle that does not initiate dispensing. Alternatively, the appliance may proceed with the user-selected cycle, but prevent use of the dispensing system. This may be accomplished through the use of a valve at the inlet or outlet of the dispensing system. When a failure mode is detected, the valve may be closed, thus preventing any dispensing.

Furthermore, the appliance may initiate a cleaning cycle after a failure mode is detected. For example, the delivery apparatus may be configured to remove residual fabric-conditioning substance from the dispenser after the fabric-conditioning substance has been dispensed. In an exemplary system including a nozzle as the dispenser and a pump as the delivery apparatus, if the reservoir is located below the nozzle, atmospheric venting may cause the fabric-conditioning substance to retract from the nozzle. Alternatively, reversing the direction of the pump after each cycle when the nozzle is used may cause the fabric-conditioning substance to retract from the nozzle. If the reservoir is located above the nozzle, reversing direction of the pump after each cycle using the nozzle may cause the fabric-conditioning substance to retract from the nozzle. Thus, residual fabric-conditioning substance may be removed from the nozzle, thereby aiding in the prevention of clogging. Other methods may be used as part of a cleaning cycle, or completed automatically to avoid clogging issues. These methods include pulsing the fabric-conditioning substance through the dispenser to cause mechanical agitation to displace residual fabric-conditioning substance, using a mechanical cleaner needle or very small pipe cleaner that clears residual fabric-conditioning substance from the dispenser orifice, using electromagnetic agitation to displace residual fabric-conditioning substance, and using a heated or vibrating dispenser enclosure. Furthermore, special dissolving chemistry may be used during a cleaning cycle to flush out the dispensing system and break down clogging particles. Alternatively, electrical current may be used to break down clogging particles. Finally, shape memory alloys or flexible nozzles may be used for the dispenser, which automatically bend, expand, or constrict to aid in forcing residual fabric-conditioning substance out of the system.

In each of the above described embodiments, the clothes dryer may include a user interface for displaying failure mode information related to the dispensing system. For example, the user interface may notify a user when a failure mode is detected. The user interface may accomplish this by displaying a message or error code, illuminating an LED, LCD, or other light display, actuating a buzzer, or by various other methods that are evident to one of skill in the art. Additionally, a user may be presented with the recommended corrective action to be completed by the user or the appliance. The user may have the option of accepting or rejecting the recommended corrective action. Furthermore, the machine may periodically alert a user that it is time to replace or clean components in the dispensing system based on the duration of use or a direct measurement of restriction, as previously described.

While the present invention has been described with reference to the above described embodiments, those of skill in the art will recognize that changes may be made thereto without departing from the scope of the invention as set forth in the appended claims.

We claim:

1. An apparatus for drying fabric articles comprising:

a treatment chamber for receiving fabric articles to be dried;

a source of heat to dry fabric articles in the treatment chamber;

a dispenser to supply a fabric-conditioning substance to the treatment chamber;

a conduit coupled to the dispenser to supply the fabric-conditioning substance to the dispenser;

a controller;

a first electrode located in the dispenser to be in contact with the fabric-conditioning substance in the dispenser; and a second electrode located in the conduit to be in contact with the fabric-conditioning substance in the conduit, wherein one of the first and second electrodes is charged, and the output of the first and second electrodes is coupled to the controller, wherein the controller is configured to determine whether a failure in dispensing fabric-conditioning substance has occurred based on the output of the first and second electrodes.

2. The apparatus of claim 1 wherein the treatment chamber is in a rotating drum.

3. The apparatus of claim 1 further comprising an enclosure having a stationary portion and a removable portion wherein the dispenser and an associated electrode are in the removable portion.

4. The apparatus of claim 3 further comprising: a coupling device, and a third electrode provided on the coupling device and adapted to align with the associated electrode when the removable portion is coupled with the stationary portion, thereby completing an electrical circuit to detect the coupling.

5. The apparatus of claim 1 wherein the controller is adapted to detect at least one of the following failure modes: a dispenser that is at least partially clogged, an outlet of the reservoir that is at least partially clogged, a conduit that is at least partially clogged, an empty reservoir, a leak in the dispensing system, and lack of a dispenser.

6. An apparatus for drying fabric articles comprising:

a treatment chamber for receiving fabric articles to be dried;

a source of heat to dry fabric articles in the treatment chamber;

a dispenser to supply a fabric-conditioning substance to the treatment chamber by way of a delivery apparatus;

a conduit coupled to the dispenser to supply the fabric-conditioning substance to the dispenser;

a controller;

a first electrode located near the delivery apparatus;

a second electrode located to be in contact with the fabric-conditioning substance in the conduit; and a third electrode located in the dispenser, wherein one of the electrodes is charged so as to complete an electrical circuit between the charged electrode and at least one other electrode, the output of the electrodes is coupled to the controller, and the controller is configured to determine whether a failure in dispensing the fabric-conditioning substance has occurred based on the output of the electrodes.

7. The apparatus of claim 6 wherein the time elapsed to complete the electrical circuit between the first and second electrodes and the first and third electrodes indicates flowrate of the fabric-conditioning substance.

* * * * *